US005967730A

United States Patent [19]

Peroni

[11] Patent Number: 5,967,730

[45] Date of Patent: Oct. 19, 1999

[54] DEVICE FOR TRANSFERRING OBJECTS

[75] Inventor: Günther Peroni, Bolzano, Italy

[73] Assignee: EXPER S.a.s. di Peroni G. & C., Terlano, Italy

[21] Appl. No.: 09/031,584

[22] Filed: Feb. 27, 1998

[30] Foreign Application Priority Data

Oct. 14, 1997 [EP] European Pat. Off. ..... 97203185

[51] Int. Cl.[6] ..... B65G 47/00

[52] U.S. Cl. ..... 414/331.05; 414/800; 198/467.1

[58] Field of Search ..... 414/331, 787, 414/800, 331.05; 198/465.4, 467.1, 678.1

[56] References Cited

U.S. PATENT DOCUMENTS

| | | | |
|---|---|---|---|
| 3,051,096 | 8/1962 | Walsh et al. | 198/465.4 X |
| 3,178,010 | 4/1965 | Van Keuren et al. | 198/685 |
| 3,770,148 | 11/1973 | Herdren | 414/287 |
| 5,125,513 | 6/1992 | Branch | 198/465.4 X |

FOREIGN PATENT DOCUMENTS

| | | |
|---|---|---|
| 0336714 | 11/1989 | European Pat. Off. . |
| 0403869 | 12/1990 | European Pat. Off. . |
| 2076351 | 12/1981 | United Kingdom . |
| 9521116 | 8/1995 | WIPO . |

*Primary Examiner*—David A. Bucci
*Attorney, Agent, or Firm*—Browdy and Neimark

[57] ABSTRACT

A device for transferring objects comprises a feeder group provided with a screw which is rotatable about a longitudinal axis thereof. The screw bears at least one container lodged between two steps of a thread thereof; the container housing an object to be transferred. The container exhibits a through-hole by which it can be freely appended to the screw, in such a way that the container can be transferred in a direction of the axis of the screw in two directions by effect of a rotation of the screw. The device comprises a magazine bearing a plurality of screws, each of which can be selectively coupled to the screw of the feeder group, in order to enable a transfer to or from the magazine to be made of a predetermined number of containers. The device is particularly useful in hospitals for automatic dispensing of single doses of medicine.

15 Claims, 2 Drawing Sheets

DEVICE FOR TRANSFERRING OBJECTS

BACKGROUND AND SUMMARY OF THE INVENTION

Specifically, though not exclusively, the invention can be useful in the field of hospital structures for moving, stocking and automatically distributing a multiplicity of single doses of medicines of various types, contained inside special packages.

The present invention proposes a new conception of a device for enabling transport of objects both simply and reliably.

An advantage of the invention is that it provides a device which is usefully applied in the field of complex plants for stocking and distributing objects.

A further advantage is that the device enables stocking of a high number of objects and renders the resulting magazine considerably efficient to manage.

A further advantage is that the device is constructionally simple and economical.

A further aim of the present invention is that it provides a method for transferring objects, of novel conception and simple and easy to put into practice.

The present invention comprises a device for transferring objects including at least one screw having threads. The objects may be supported between steps of the threads and are transferable along an axis of the screw in two directions by effect of rotation of the screw.

These aims and advantages and others besides are all attained by the invention, as it is characterised in the accompanying claims.

BRIEF DESCRIPTION OF THE DRAWINGS.

Further characteristics and advantages of the present invention will better emerge from the detailed description that follows of a preferred but non-exclusive embodiment of the invention, illustrated purely by way of non-limiting example in the accompanying figures of the drawings, in which.

Figure 1:
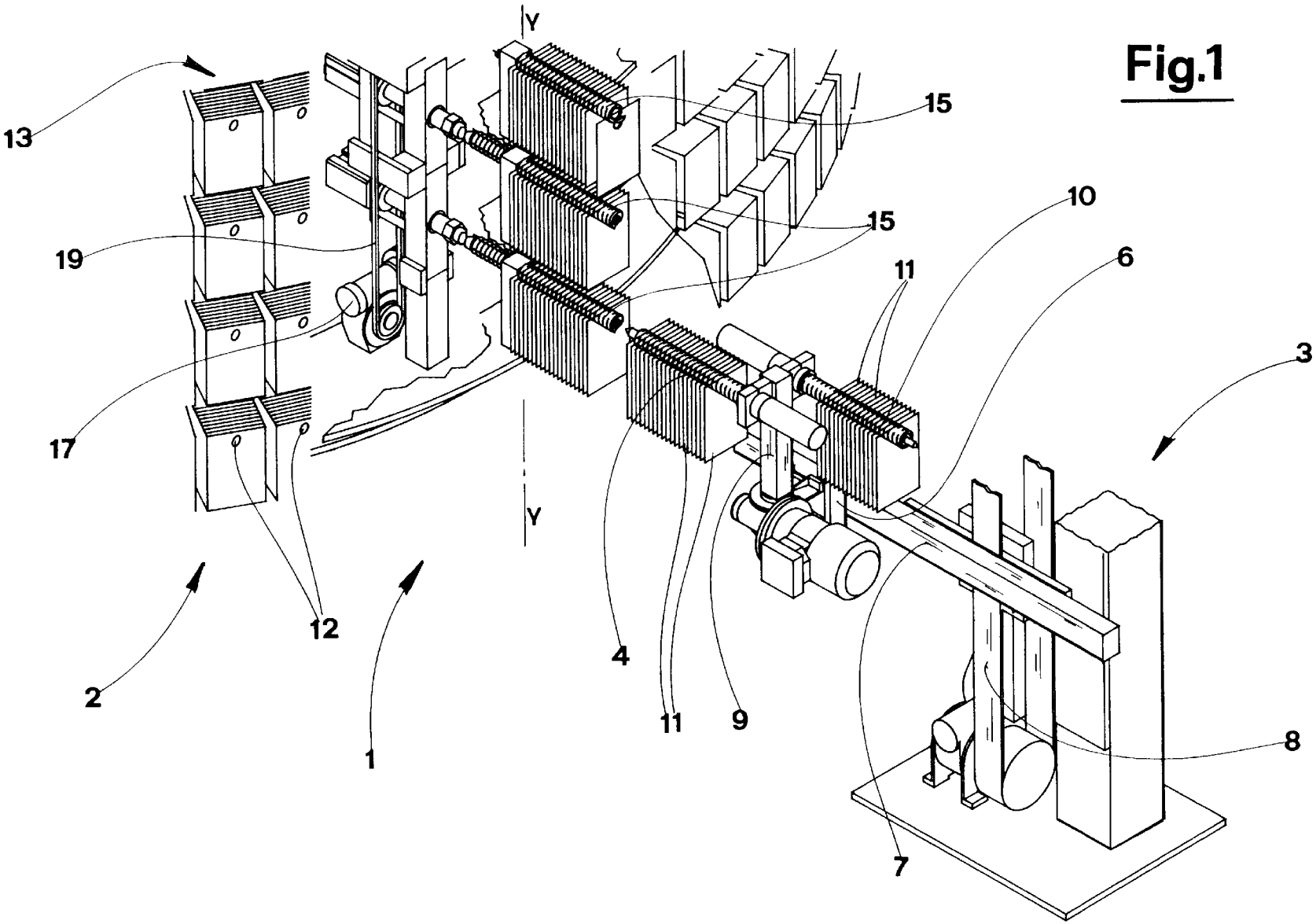
FIG. 1 shows a schematic perspective view of a device made according to the present invention.

DESCRIPTION OF THE PREFERRED EMBODIMENTS.

With reference to the above-mentioned figures, 1 denotes in its entirety a device for transfer of objects, used in the present example for automatically moving and stocking a multiplicity of objects of various types, of relatively small sizes, such as for example single-dose packages of medicines of various types used in the hospital field.

The device 1 comprises in this case a magazine 2 for the objects and a feeder group 3 both for providing the magazine 2 with the objects and for removing the objects from the magazine.

The feeder group 3 will now be described. This group comprises at least one screw 4 which can rotate on command about a longitudinal axis thereof. The screw is preferably arranged with said axis in a horizontal position. In the specific case, the screw 4 is cylindrical, with constant step, and comprises a cylindrical central core about which is wound a helical relief.

The screw 4 is commanded by means of a motor 5 to rotate by predetermined entities. The entity of this rotation is preferably, but not necessarily, a whole multiple of a revolution, for reasons that will become evident herein below.

The motor 5 can be constituted, for example, by a step motor.

The screw 4 is mounted on a slide 6 which is slidably coupled on a straight guide 7 having a sliding axis which is parallel to the screw axis. The guide 7 is solidly constrained to a belt 8 with freedom to move vertically in both directions. The screw 4 can perform at least two movements; in a horizontal direction, allowing the screw 4 to near and distance to and from the periphery of the magazine 2, and in a vertical direction, allowing the screw to position itself facing the magazine 2 at a predefined height along the magazine itself. The screw 4 is mounted on the superior part of a rotatable support shaft 9 having a vertical axis x—x. The support shaft 9 further bears a second screw 10, identical to and arranged symmetrically to the first screw 4, with an axis of symmetry which coincides with the vertical axis x—x of the support shaft 9, so that the two screws 4 and 10 can exchange positions by effect of a 180° rotation of the shaft 9.

The screw 4 (like the other screw 10) can house, appended by two consecutive thread steps, at least one support to which at least one object to be transferred can be associated. In the illustrated case, this support comprises a container 11 able to house at least one object which in the example is represented by a single dose of a medicine, for example a pill or capsule. The container 11 exhibits an eye 12 in which a screw can insert so that the container 11 can be appended between two consecutive steps of the screw 4. In the present case the container 11 is a sachet, in which a dose is inserted, which sachet is superiorly provided with a through-hole constituting said eye 12.

The container 11, or other type of support, is freely appended on the screw by said eye, so that it is transferable along the axial direction of the screw in both directions by effect of the rotation of the screw. In the example the eye diameter is greater than the diameter of the central core of the screw and smaller than the external diameter of the thread.

Each screw 4 and 10 is able to support and advance a plurality of sachet-type containers 11.

Now the magazine 2 will be described, which in the present example comprises a carousel 13, rotatable on command about a vertical axis y—y of rotation. The carousel 13 supports a plurality of screws 15 which axes are arranged radially with respect to the axis of the carousel 13. The screws 15 are arranged on various horizontal lines with circumferential extensions, with the lines being located one on another in such a way that the screws 15 are in columns in a vertical direction.

Each screw 15 of the magazine, which is identical to screws 4 and 10 of the feeder group, can be selectively coupled to one or more screws external to the magazine. The external screws are in the present example constituted by screws 4 and 10 of the above-described feeder group 3. It is, however, possible to predispose further screws externally to the magazine 2, which screws would be situated in proximity of the periphery of the magazine 2 itself. The coupling between the magazine screws 15 and the external screws is achieved in such a way that it is possible to transfer predetermined quantities of supports from the magazine 2 towards the outside and viceversa.

Figure 2:
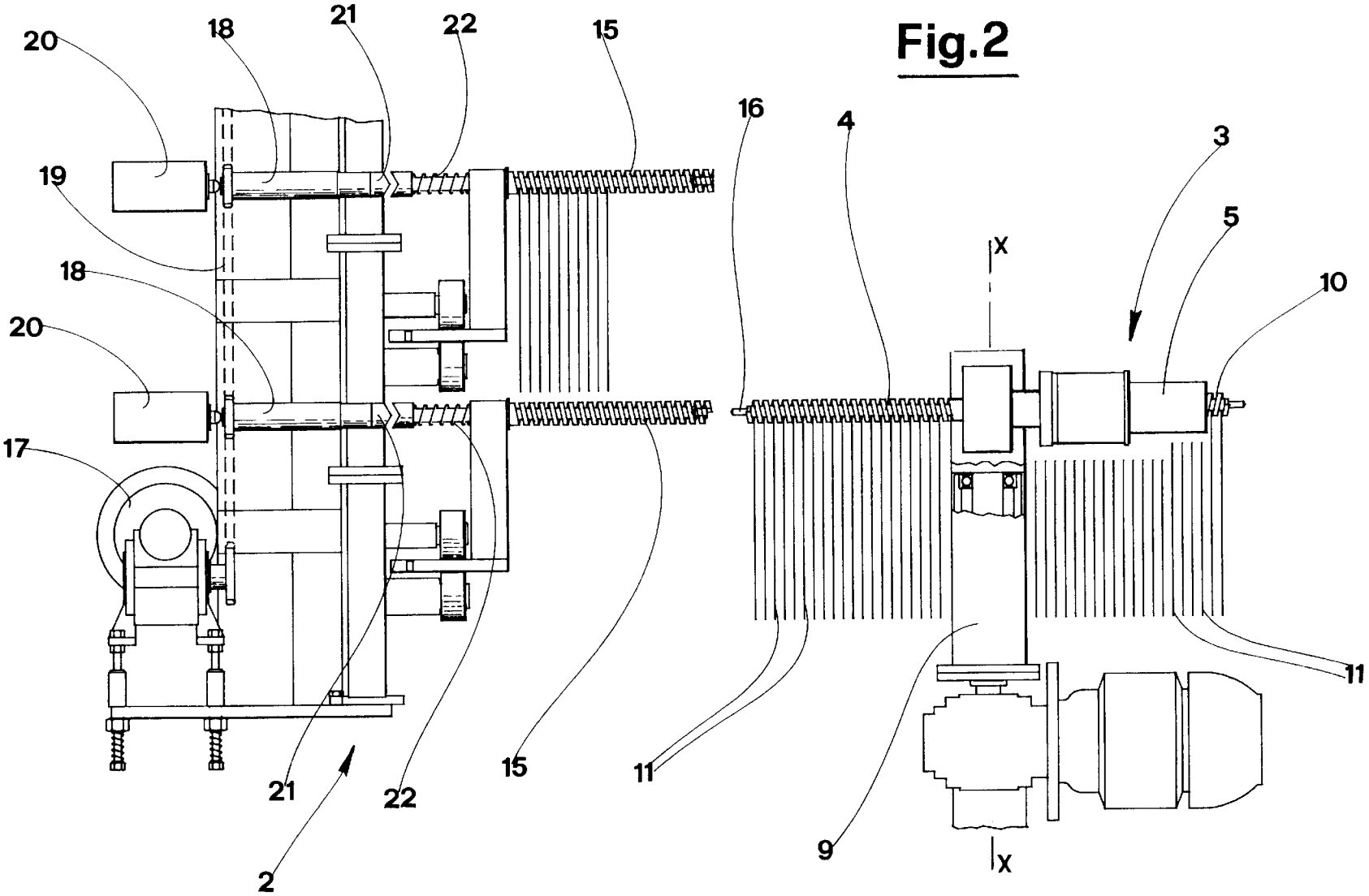
FIG. 2 shows a schematic lateral vertical elevation of a detail of the device of FIG. 1.

FIG. 2 shows two screws 15 and 4, one belonging to the magazine and the other to the feeder group, having threads angled in the same direction, co-aligned, in a configuration in which a head of an end of each thereof is set facing the other. The threads 15 and 4 are reciprocally and freely couplable at said facing ends, so that one screw becomes in effect the continuation of the other and the two screws are reciprocally solid in rotation. In substance, since they can be coupled, the two screws 15 and 4 together form a single continuous screw. This enables the objects to be passed from one screw to the other unproblematically. Each screw 4 and 10 of the feeder group 3 can selectively assume at least a first position, in which it is coupled with a screw 15 of the magazine, and forms therewith a single continuous screw, and a second position (FIG. 2) in which the two screws 15 and 4 are coaligned and present their respective ends at a reciprocal distance. The end of one screw 4 of the feeder group 3 exhibits a coaxial projection 16 destined to couple with a recess on the end of the other screw. The first position is reached, starting from the position of FIG. 2, by nearing the screw 4 of the feeder group to the screw 15 of the magazine, up until the projection 16 connects with the recess. Each screw 15 of the carousel, able to stock a plurality of containers 11 appended between the steps of its thread, can be lined up to one or another of the screws 4 and 10 of the feeder group 3, through a special rotation of the carousel 13 and a special vertical displacement of the feeder group 3.

Each screw 15 of the carousel can be commanded to rotate about its longitudinal axis by the motor 5 actuating a screw in the feeder group 3, when the two screws are engaged head-to-head and reciprocally solid in rotation. Each screw 15 of the carousel can however be commanded to rotate by its own independent actuating means, which means comprise a plurality of motors 17, one for each column of screws 15 of the carousel, each of which sets a plurality of rotatable shafts 18 in rotation; each shaft is coaxial with a corresponding screw 15 of the column and can be removably coupled on command with the screw 15. The shafts 18 are also arranged in columns and in circumferential rows. Each motor 17 associated to a column of screws can be connected to various rotatable shafts 18 of the columns by means of a flexible organ, such as for example a chain 19, which draws all of the shafts 18 in rotation.

Also provided are means for coupling which selectively couple a screw 15 in rotation with a respective coaxial shaft 18. In the present example, the means for coupling comprise, associated to each shaft 18, an element which is solid in rotation with the shaft and able to slide axially with respect to the shaft itself, which can be commanded by a pusher organ 20 to engage with the screw 15 by an end 21 thereof which faces a corresponding end of the screw 15. To uncouple the shaft 1I from the screw 15 the mobile element of the pusher organ 20 is retreated; a return spring 22 guarantees disengagement.

The carousel 13 is provided with a computerised command and control unit, not illustrated, for commanding the carousel so that it unloads at predetermined points the single doses of the type and number requested. In particular, this unit controls the number of rotations made by the screw which loads or unloads the containers, inasmuch as for each revolution of the screw there is an axial advancement of the container which is equal to the screw step. So, at each revolution of the screw a single container can be unloaded: thus, by counting the number of revolutions it is possible to calculate how many containers have been loaded or unloaded. The single-dose sachets can be loaded or unloaded at the feeder group position 3, or at another loading and unloading station (not illustrated).

The device of the invention can be used as a dispensing magazine of single doses of medicines. The magazine can be automatically reloaded using the feeder group 3; the relative position on the carousel is registered in an appropriate memory installed in the control unit. When needed, an operator can request a number and type of single-dose unit through the control unit, whereupon the unit itself will command the device to perform the operations necessary for unloading the ordered number and type from the magazine.

During functioning, the device for transferring objects as described above performs the following operations: appending at least one container 11 of an object to be transferred between two consecutive steps of a screw thread on a screw which can be commanded to rotate about a longitudinal axis thereof; rotating the screw by predetermined amounts so as to transfer the container 11 along the axis of the screw in both directions.

In the special embodiment described herein, the method involves coupling at least two screws together (the screw steps inclining in a same direction), for example screws 4 and 15, with reference to the illustrations, at facing heads thereof, so that one screw is in effect the continuation of the other, the screws also being made solid in rotation. The method thus involves impressing predeterrnined-entity rotations on the aforementioned screws so that a container 11 is transferred from a first of the screws to a second thereof.

What is claimed:

1. A device for transferring objects, comprising a first screw and a second screw each able to rotate on command about their respective longitudinal axis, said first screw being able on command to lodge at least one support of an object to be transferred between steps of a thread of said first screw; said at least one support being appended on said first screw in such a way as to be transferable along an axis of said first screw in two directions by effect of a rotation of said first screw, said second screw rotatable about a vertical axis to a position where its end meets the end of said first screw to enable said second screw to receive the support from said first screw, and said second screw is rotatable about said vertical axis in a direction away from said first screw to transfer said support in a direction away from said first screw.

2. The device of claim 1, wherein said at least one screw is commanded by a motor to rotate by predetermined amounts.

3. The device of claim 2, wherein said predetermined amount of rotation is a whole multiple of a revolution of said at least one screw.

4. The device of claim 3, comprising said two screws, each having a thread angled in a same direction as threads of the other of said two screws; which two screws are couplable one to another by ends thereof, in such a way that one of said two screws is in effect a continuation of another thereof.

5. The device of claim 4, wherein at least one of said two screws is able selectively to assume at least a first position, in which the two screws are coupled one to another at ends thereof, and a second position in which the two screws are coaligned with said ends thereof distanced one from another.

6. The device of claim 4, wherein an end of at least one of said two screws exhibits a coaxial projection destined to couple with a recess afforded at an end of another of said two screws.

7. The device of claim 5, wherein an end of at least one of said two screws exhibits a coaxial projection destined to couple with a recess afforded at an end of another of said two screws.

8. The device of claim 4, comprising a magazine containing a plurality of said screws, each of which screws can be selectively coupled with one or more screws which are external of said magazine, so that a predetermined quantity of said containers can be transferred either from or to said magazine.

9. The device of claim 8, wherein said screw is cylindrical and has a constant step.

10. The device of claim 9, wherein said at least one screw comprises a cylindrical central core.

11. The device of claim 1, wherein said container exhibits an eye into which the screw can be inserted in such a way that the container can be appended between two consecutive steps of the thread of said screw.

12. The device of claim 11, wherein said container is a sachet superiorly provided with a through-hole constituting said eye.

13. A device for transferring objects, comprising a magazine having a vertical axis of rotation, including a carousel which is rotatable on command, containing a plurality of screws, axes of said screws arranged in a radial direction with respect to an axis of the carousel, each of said screws having a thread angled in a same direction as threads of the other of said screws, said screws able to rotate on command about a longitudinal axis thereof, said screws being able on command to lodge at least one support of an object to be transferred between steps of a thread of at least one of said screws; said at least one support being appended on said at least one of said screws in such a way as to be transferable along an axis of said at least one of said screws in two directions by effect of a rotation of said at least one of said screws, wherein said screws are commanded by a motor to rotate a whole revolution of said screws, said screws selectively couplable one to another by ends thereof, external of said magazine so that a predetermined quantity of said supports can be transferred either from or to said magazine, in such a way that one of said screws is in effect a continuation of another of said screws.

14. The device of claim 13, wherein the screw which is external of the magazine can be displaced in a vertical direction.

15. A method for transferring objects comprising the following operations:

appending at least one support, bearing at least one object to be transferred, between two consecutive steps of a thread of a first screw, which first screw is able to rotate on command about a longitudinal axis thereof of a feeder device;

rotating said first screw by predetermined quantities in order to transfer said support along said longitudinal axis of said first screw;

providing a carousel having a second screw thereon, said second screw adapted to align with said first screw and adapted to receive said support bearing at least one object directly from said first screw through rotation of said first screw and said second screw;

wherein said object is at least temporarily stored at said carousel.

* * * * *